US010940064B2

(12) United States Patent
Janikowski et al.

(10) Patent No.: US 10,940,064 B2
(45) Date of Patent: Mar. 9, 2021

(54) WHEELCHAIR HANDGRIP APPARATUSES

(71) Applicants: Carla J. Janikowski, Hatley, WI (US); Randy Janikowski, Hatley, WI (US)

(72) Inventors: Carla J. Janikowski, Hatley, WI (US); Randy Janikowski, Hatley, WI (US)

( * ) Notice: Subject to any disclaimer, the term of this patent is extended or adjusted under 35 U.S.C. 154(b) by 171 days.

(21) Appl. No.: 16/012,304

(22) Filed: Jun. 19, 2018

(65) Prior Publication Data

US 2019/0380892 A1 Dec. 19, 2019

(51) Int. Cl.
*A61G 5/02* (2006.01)
*A61G 5/10* (2006.01)

(52) U.S. Cl.
CPC ..... *A61G 5/028* (2013.01); *A61G 5/021* (2013.01); *A61G 5/024* (2013.01); *A61G 5/10* (2013.01)

(58) Field of Classification Search
CPC ..... A61G 5/028; A61G 5/021; A61G 5/024; A61G 5/10
See application file for complete search history.

(56) References Cited

U.S. PATENT DOCUMENTS 2,876,486 A 3/1959 Lindstrom
3,189,368 A * 6/1965 Petersen ..... A61G 5/022 280/250.1
3,623,748 A 11/1971 Haynes
3,869,146 A * 3/1975 Bulmer ..... A61G 5/023 280/250.1
5,988,661 A * 11/1999 Garfinkle ..... A61G 5/025 280/242.1
D418,779 S 1/2000 Greaves et al.
6,203,101 B1 3/2001 Chou et al.
D439,869 S 4/2001 Kjell et al.
6,241,268 B1 6/2001 Niklasson
6,276,705 B1 8/2001 Baldwin et al.
6,352,307 B1 3/2002 Engman
6,439,281 B1 8/2002 Hogg
6,634,663 B2 * 10/2003 Mitchell ..... A61G 5/022 280/250.1
6,722,680 B2 4/2004 DeLong et al.
7,040,642 B2 5/2006 Lowry
7,234,717 B1 * 6/2007 Thomas ..... A61G 5/02 280/250.1

(Continued)

FOREIGN PATENT DOCUMENTS

JP 2013-13698 1/2013

*Primary Examiner* — Kevin Hurley
*Assistant Examiner* — Marlon A Arce
(74) *Attorney, Agent, or Firm* — Andrus Intellectual Property Law, LLP

(57) ABSTRACT

An apparatus for facilitating user propulsion of a wheelchair having a frame for supporting a user and a pair of rear wheels that rotate about an axis. The apparatus includes a handgrip having an outer surface and an opposite, inner surface such that when a radial force relative to the axis is applied to the outer surface by the user the inner surface is configured to engage a rear wheel in the pair of rear wheels such that the rear wheel can be rotated and the wheelchair propelled. A pair of coupling members configured to couple the handgrip to the frame and hold the handgrip in a neutral position, and the pair of coupling members are further configured to alternately increase in length and become tensioned as the user moves the handgrip away from the neutral position to rotate the wheel.

15 Claims, 3 Drawing Sheets

(56) References Cited

U.S. PATENT DOCUMENTS

| | | | | |
|---|---|---|---|---|
| D552,856 | S | 10/2007 | Chan | |
| 7,296,811 | B2 * | 11/2007 | Pettit | A61G 5/022 280/242.1 |
| 7,427,105 | B2 | 9/2008 | Knoblock et al. | |
| 7,497,456 | B2 | 3/2009 | Willems et al. | |
| D597,329 | S | 8/2009 | Tanaka et al. | |
| D665,587 | S | 8/2012 | Lloyd et al. | |
| D674,729 | S | 1/2013 | Goldstein | |
| D679,513 | S | 4/2013 | Braverman | |
| 8,505,946 | B2 * | 8/2013 | Joo | A61G 5/022 280/242.1 |
| 8,544,865 | B1 | 10/2013 | Janikowski | |
| D705,134 | S | 5/2014 | Childs et al. | |
| D732,439 | S | 6/2015 | Childs et al. | |
| 9,597,241 | B2 * | 3/2017 | Zondervan | A61G 5/025 |
| D829,137 | S | 9/2018 | Hommen et al. | |
| D873,183 | S | 1/2020 | Gabriely et al. | |
| 2001/0007389 | A1 | 7/2001 | Frauwirth | |
| 2002/0125711 | A1 | 9/2002 | Calhoun | |
| 2006/0261571 | A1 * | 11/2006 | Mitchell | A61G 5/022 280/250.1 |
| 2011/0175329 | A1 | 7/2011 | Gingras et al. | |
| 2019/0151168 | A1 * | 5/2019 | Jones | A61G 5/022 |

* cited by examiner

WHEELCHAIR HANDGRIP APPARATUSES

FIELD

The present disclosure relates to wheelchair handgrip apparatuses, and particularly sanitary wheelchair handgrip apparatuses that permit a user to rotate rear wheels of a wheelchair and thereby propel the wheelchair without directly contacting the rear wheels.

BACKGROUND

The following U.S. Patent is incorporated herein by reference in entirety.

U.S. Pat. No. 8,544,865 discloses a wheelchair propulsion and contamination reduction arrangement that permits the user to drive the chair on main ground-engaging rear wheels with a compressible wheel cover that is grasped and squeezed against the wheel to provide propulsion and mounted with elastic tension devices on opposite ends that return the drive grip to a neutral position when the user relaxes the compression. The compressible device is a polymeric foam which can also be adapted to carry one or more of a lubricant, cleaner, and biostatic treatment.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an apparatus for facilitating user propulsion of a wheelchair having a frame for supporting a user and a pair of rear wheels that rotate about an axis includes a handgrip having an outer surface and an opposite, inner surface with a plurality of projections extending therefrom such that when a radial force is applied by the user to the outer surface the plurality of projections are configured to engage with a rear wheel in the pair of rear wheels such that the rear wheel can be rotated and the wheelchair propelled.

In certain examples, an apparatus for facilitating user propulsion of a wheelchair having a frame for supporting a user and a pair of rear wheel that rotate about an axis includes a handgrip having an outer surface and an opposite, inner surface such that when the user applies a radial force relative to the axis to the outer surface the inner surface is configured to engage a rear wheel in the pair of rear wheels such that the user can rotate the rear wheel and propel the wheelchair. A pair of coupling members are configured to couple the handgrip to the frame and hold the handgrip in a neutral position. The pair of coupling members are further configured to alternately increase in length and become tensioned as the user moves the handgrip away from the neutral position to rotate the wheel, and the coupling member that is tensioned moves the handgrip back to the neutral position when the user releases the handgrip.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Health and governmental agencies such as the Occupational Safety and Health Administration (OSHA), the Center for Disease Control and Prevention (CDC), and other similar state agencies and authorities regulate standards and regulations for minimizing contamination of appliances, articles, and/or various devices that are touched or used by patients and/or residents in hospitals, nursing homes, and other healthcare related institutions. As is described in above-incorporated U.S. Pat. No. 8,544,865, wheelchairs are particularly problematic and well known source of contaminants. Conventional wheelchair have two main large diameter rear wheels with concentrically smaller diameter push or drive wheels that are engaged by the user of the wheelchair to rotate the wheel and thereby propel the wheelchair. That is, the user typically grasps the smaller diameter concentric wheel to propel the wheelchair and avoid contact with the rear wheels that engage the floor. Regulations typically require periodic cleaning of the rear wheels, but freshly cleaned rear wheels will become quickly contaminated as the wheelchair is used by the user.

The present inventors have observed that conventional wheelchairs with handgrips that protect the user from the wheel and help the user propel the wheelchair can be improved. For example, conventional handgrips with foam inserts or porous materials are susceptible to damage and the straps may be coupled to the handgrip and/or the wheelchair in such a way that fraying and/or failure of the straps can occur. Through research and experimentation, the present inventors have developed improvements to sanitary handgrip or drive grip apparatuses that are grasped by the user to rotate the rear wheels and propel the wheelchair without directly contacting the rear wheels. The handgrip apparatuses of the present disclosure advantageously provide a sanitary barrier between the user and the wheels, allow the user to easily propel the wheelchair, and simplify the action necessary to engage and propel the wheels.

Figure 1:
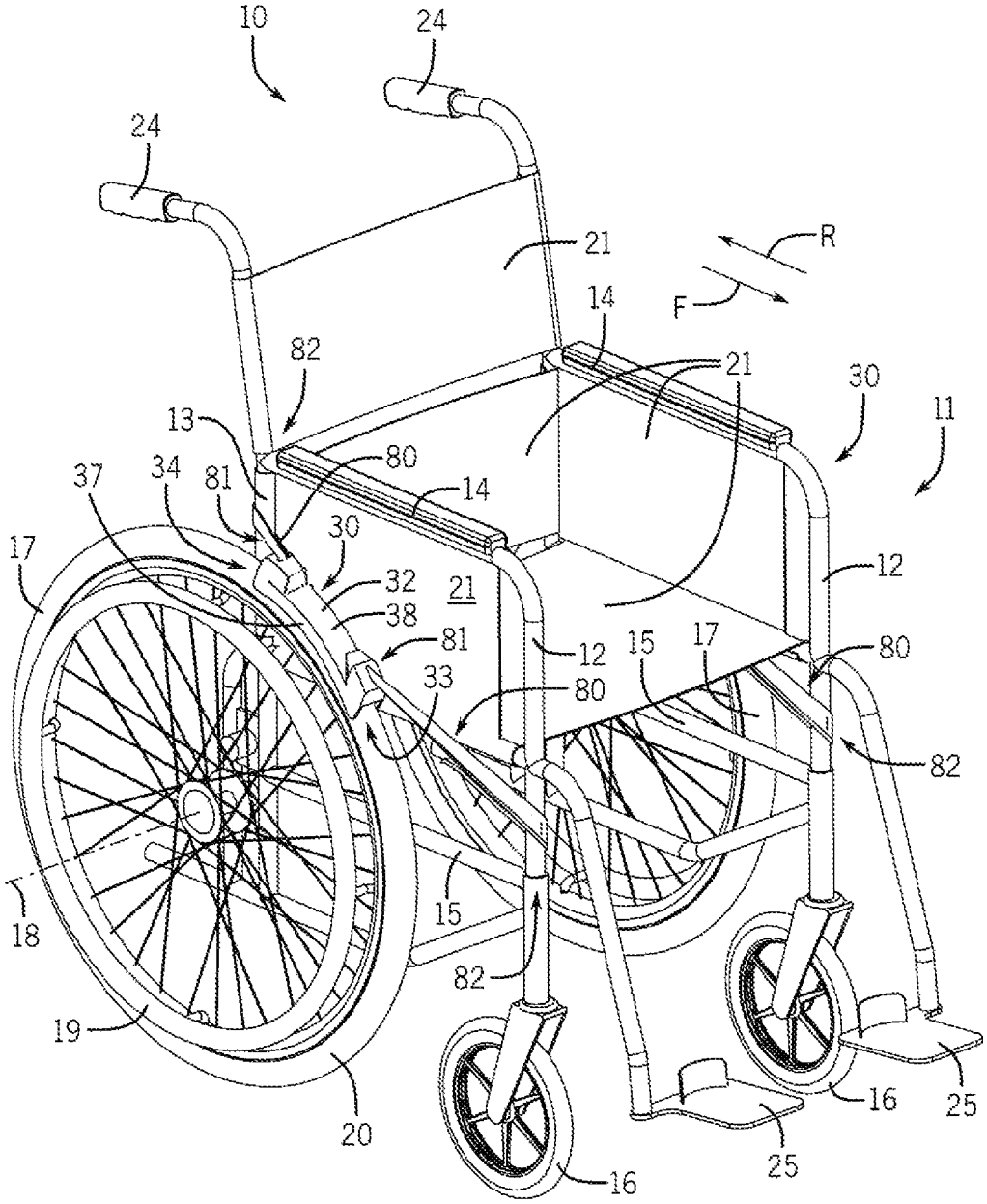
FIG. 1 is a perspective view of a wheelchair to which a handgrip apparatus of the present disclosure is attached.

FIG. 1 depicts a conventional wheelchair 10 having a generally typical construction and a pair of handgrip apparatuses 30 (described further herein) of the present disclosure attached to the wheelchair 10. The wheelchair 10 includes a frame 11 that provides support for a seated user. The frame 11 has front frame members 12 and rear frame member 13 that are interconnected with side frame members 14, 15. A pair of front support castors or wheels 16 are connected to the front frame members 12, and a pair of large diameter rear wheels 17 are rotatably coupled to the side frame members 14, 15. The rear wheels 17 rotate about an axis 18, and can include a rubber (or other suitable material) tire 20. Flexible cloth or cloth-like panels 21 are attached to the frame 11 to support the user in the wheelchair 10. Push arms 24 coupled to the rear frame members 13 and permit another person to propel the wheelchair 10, and foot supports 25 are pivotably and/or rotatably coupled to the front frame members 12.

The pair of handgrip apparatuses 30 are coupled to the frame 11 by coupling members 80 (described further herein), and the handgrip apparatuses 30 permit the user to propel the wheelchair 10 without directly touching the rear wheels 17. Each handgrip apparatus 30 includes a handgrip 32 that is positioned adjacent to the rear wheels 17 such that the user can rotate the rear wheels 17 and thereby propel the wheelchair 10 (forwardly or rearwardly) by applying a downwardly oriented force to the handgrip 32 which causes the handgrip 32 to engage the rear wheel 17. While the handgrip 32 is in contact with the rear wheel 17 the user can then rotate the rear wheel 17 by applying a rotational force relative to the axis 18 to the handgrip 32 thereby rotating the rear wheel 17 and propelling the wheelchair 10.

Figure 6:
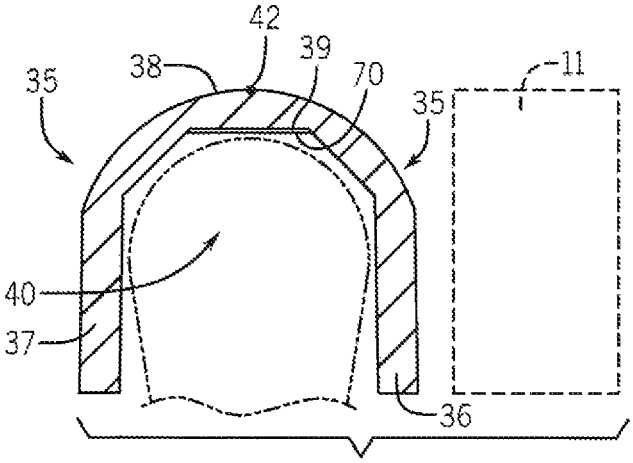
FIG. 6 is a lateral cross-section view of the handgrip of FIG. 2 along line 6-6 of FIG. 2.

FIGS. 2-6 depict an example handgrip 32 in greater detail. The handgrip 32 has a first end 33, an opposite, second end 34, and a pair of opposing sides 35. That handgrip 32 includes a first or outer surface 38 that is engaged or contacted by the user and an opposite second or inner surface 39 that contacts the rear wheel 17. A first side member 36 and a second side member 37 are positioned at the opposing sides 35, respectively, and extend away from the outer and inner surfaces 38, 39. The first side member 36 is positioned nearer the frame 11 of the wheelchair (FIG. 1) than the second side member 37. The handgrip 32 defines a channel 40 that receives at least a portion of the outer circumference of the rear wheel 17. The shape of the handgrip 32 can vary (e.g. flat, tubular semi-circumferential). In certain examples, the handgrip 32 is curved to closely match the radius of curvature or circumference of the rear wheel 17. The shape of the channel 40 can vary. Furthermore, the size and shape of the side members 36, 37 can vary. For example, the second side member 37 can be smaller or shorter than the first side member 36 such that the handgrip 32 can accommodate wheelchairs with large drive or push wheels 19 (FIG. 1) that are attached to the rear wheels 17. In some examples, the side members 36, 37 are curved and the handgrip 32 has a cross section that is generally U-shaped (FIG. 6). The handgrip 32 defines a longitudinal centerline 42 that extends along the length of the handgrip 32 between the opposing sides 35. The handgrip 32 also includes opposing endwalls 41 that extends between the opposing sides 35. The endwalls 41 increase the rigidity of the handgrip 32 and prevent the opposing side member 36, 37 from bending away from each other. The endwalls 41 also act as a barrier or scraper to prevent debris from entering the channel 40. The handgrip 32 can be made of any suitable material such as rubber, non-porous plastic, thermoplastic polyurethane elastomer (e.g. ESTANE 2103-90A manufactured by Lubrizol Advanced Materials, Inc.), and the like. The size and shape of the handgrip 32 can also vary.

A first raised section 50 is positioned at the first end 33 of the handgrip 32 and extends away from the outer surface 38. Similarly, a second raised section 54 is positioned at the second end 34 and extends away from the outer surface 38. The raised sections 50, 54 define an elongated cutout 56 there between that is configured to receive the hand of the user when the user makes contact with the outer surface 38. That is, the raised sections 50, 54 prevent the hand of the user from slipping from the outer surface 38 to a position in front of the first end 33 and/or behind the second end 34. The first raised section 50 is ergonomically shaped to receive or generally match the space between the thumb and index finger of the user's hand as the user contacts the handgrip 32. In the example depicted, the first raised section 50 has a pair of raised surfaces 51, 52 that extend away from the outer surface 38. The raised surfaces 51, 52 extend perpendicular from the outer surface 38, however, a person having ordinarily skill in the art will recognize that the raised surfaces 51, 52 may extend at any angle from the outer surface 38 such that the raised surfaces 51, 52 are sloped or angled relative to the outer surface 38. The raised surfaces 51, 52 also transversely extend from the opposing sides 35, respectively, such that the raised surfaces 51, 52 intersect each other at the centerline 42 (e.g. the raised surfaces 51, 52 form a triangle). The raised surfaces 51, 52 are perpendicular to each other and define a right angle there between (see FIG. 2, angle A). The first raised section 50 defines a first cavity 58 that is adjacent to, connected to, and/or in communication with the channel 40.

The second raised section 54 is shaped to abut the palm or wrist of the user's hand as the user contacts the handgrip 32. In the example depicted, the second raised section 54 has a raised surface 55 that extends away from the outer surface 38. The raised surface 55 perpendicularly extends from the outer surface 38, however, a person having ordinarily skill in the art will recognize that the raised surface 55 may extend at any angle from the outer surface 38 such that the raised surface 55 is sloped or angled relative to the outer surface 38. The raised surface 55 transversely extends from the opposing sides 35 (e.g. the raised surface 55 forms a flat or square portion of the second raise section 54). A person having ordinary skill in the art will recognize that the size and shape of the raised sections 50, 54 can vary. The second raised section 54 defines a second cavity 59 that is adjacent to, connected to, and/or in communication with the channel 40.

Figure 2:
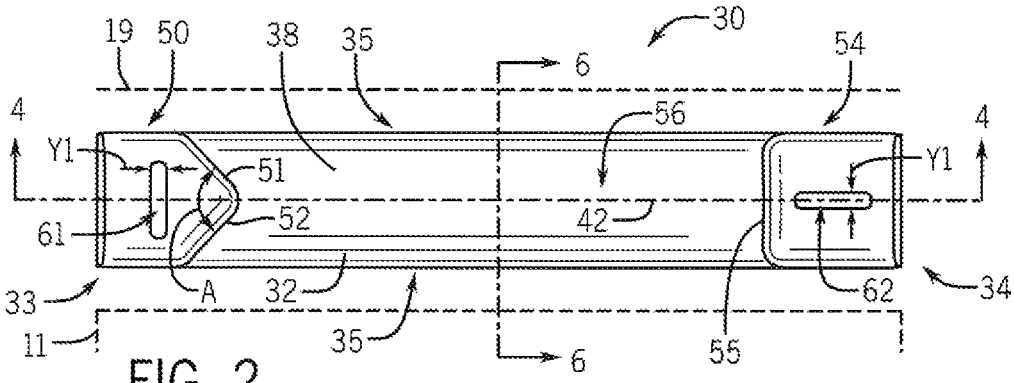
FIG. 2 is a top view of an example handgrip of the present disclosure.
Figure 3:
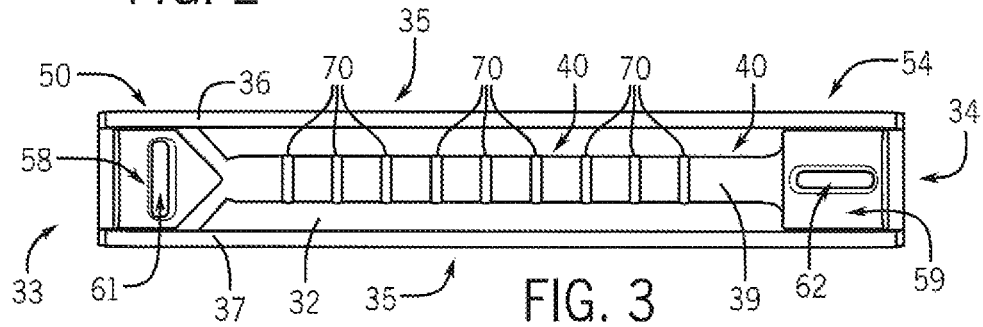
FIG. 3 is a bottom view of the handgrip depicted in FIG. 2.
Figure 4:
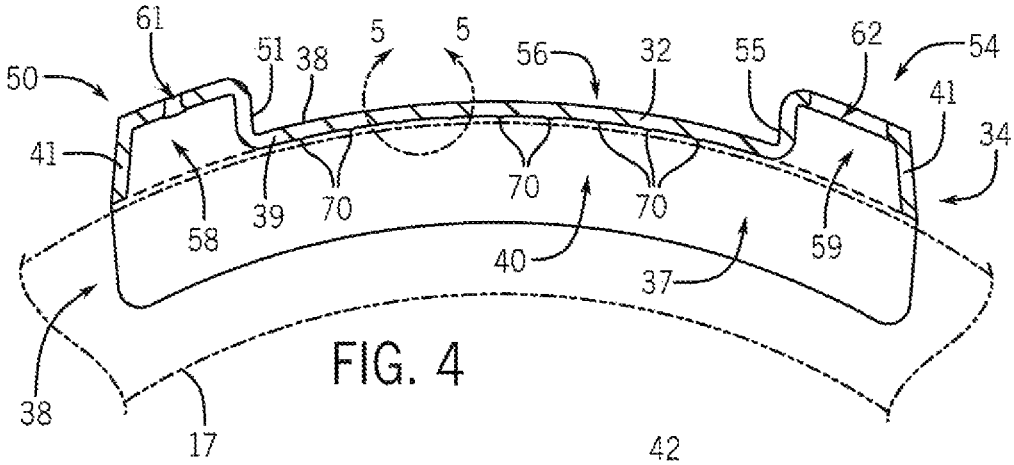
FIG. 4 is a longitudinal cross-sectional view of the handgrip of FIG. 2 along line 4-4 of FIG. 2.
Figure 5:
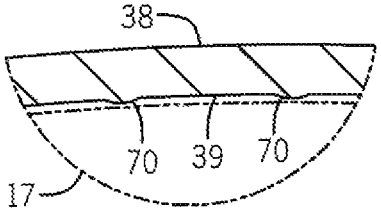
FIG. 5 is an enlarged section of the handgrip depicted in FIG. 4 within line 5-5 of FIG. 4.

A pair of holes, namely a first hole 61 and a second hole 62, are defined in the handgrip 32 and are configured to receive coupling members 80 (described herein) there through. The first hole 61 is positioned near the first end 33 and the second hole 62 is positioned near the second end 34. The first hole 61 is an elongated opening that is transversely oriented relative to the centerline 42, and the second hole 62 is an elongated opening that is parallel with the centerline 42. The second hole 62 is parallel with the centerline 42 so that the coupling member 80 wrapping around the frame 11 of the wheelchair 10 lays flat against the frame 11 and is not twisted (see FIG. 1). A person having ordinary skill in the art will recognize that the shape, size, and orientation of the holes 61, 62 can vary. The holes 61, 62 have a width Y1 (FIG. 2).

The inner surface 39 has a plurality of projections 70 extending therefrom that are configured to be pressed into contact with the rear wheel 17 when the user applies a force to the outer surface 38 of the handgrip 32. That is, the projections 70 make contact with the rear wheel 17 when the user presses on the handgrip 32 (e.g. applies a radial force relative to the axis 18) such that the user can rotate the rear wheel 17 and propel the wheelchair 10 in a first direction (e.g. forward direction) or in a second direction opposite the first direction (e.g. rearward direction) (see FIG. 1 arrow F depicts a front/forward direction and arrow R depicts a rear/rearward direction). The spacing, size, and shape of the projections 70 can vary, and in the example depicted (see FIGS. 3 and 6) the projections 70 are elongated ribs that have an elongated semi-circular shape (e.g. the projections are half cylinders or have a half-cylindrical shape). The projections 70 are equally spaced apart from each other (see FIG. 3) and aligned along the inner surface 39 of the handgrip 32. The projections 70 extend between the opposing sides 35. In certain examples, the projections 70 transversely extend between the opposing sides 35. In other examples, the projections 70 perpendicularly extend between the opposing sides 35.

Figure 7:
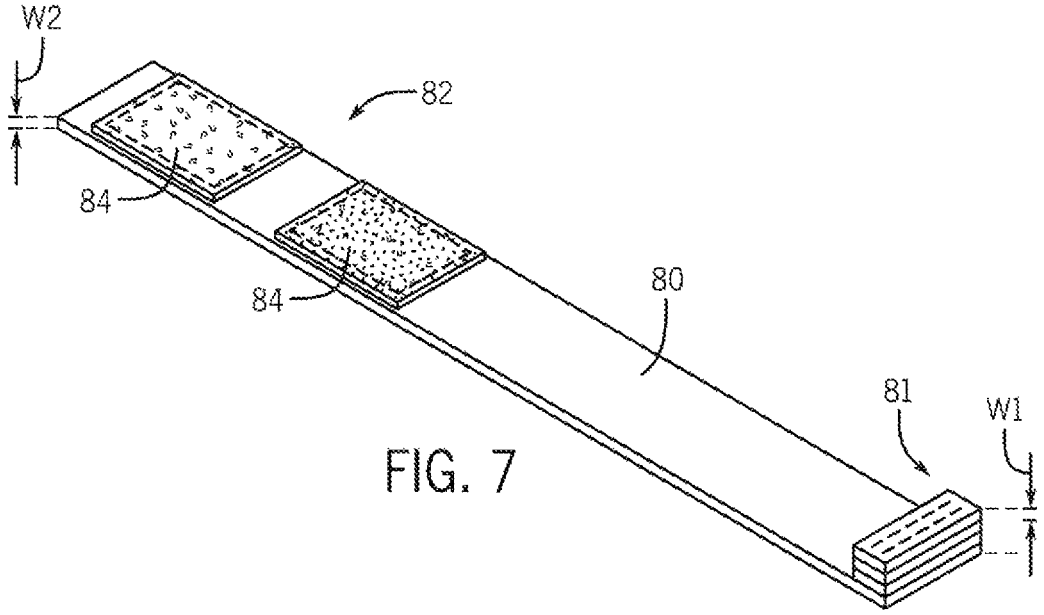
FIG. 7 is an example coupling member of the present disclosure.

The handgrip apparatus 30 includes coupling members 80 (e.g. straps) that couple the handgrip(s) 32 to the frame 11 of the wheelchair 10. Each coupling member 80 is elastic (e.g. made of elastic material) and is configured to elongate or stretch as the handgrip 32 is moved by the user (described herein). In the example depicted, the coupling member 80 has a first end 81 that is thickened or enlarged relative to an opposite, second end 82. That is, the width or thickness W1 of the first end 81 is greater than the width or thickness W2 of the second end 82 of the coupling member 80. The width W1 of the first end 81 is also greater than the width Y1 of the holes 61, 62. In the example depicted in FIG. 7, the first end 81 includes several layers of material that increase the thickness of the coupling member 80 at the first end 81. A person having ordinary skill in the art will recognize that the first end 81 can be thickened by adding components (e.g. nut and bolt), adding material layers (e.g. overlapping or bunching a portion of a strap by sewing), and/or the like. The second end 82 includes fastening components 84 that fasten the second end(s) 82 to the wheelchair 10. In certain examples, the fastening components 84 couple to fastening components of other coupling members 80. The type, size, and shape of fastening components 84 can vary, and example fastening components 84 can include mechanical couplers, adhesive, and/or the like. In the example depicted, the fastening components 84 are hook-and-loop pads that are configured to releasably couple to each other when the second end 82 is wrapped around the wheelchair 10 and/or the frame 11.

Figure 8:
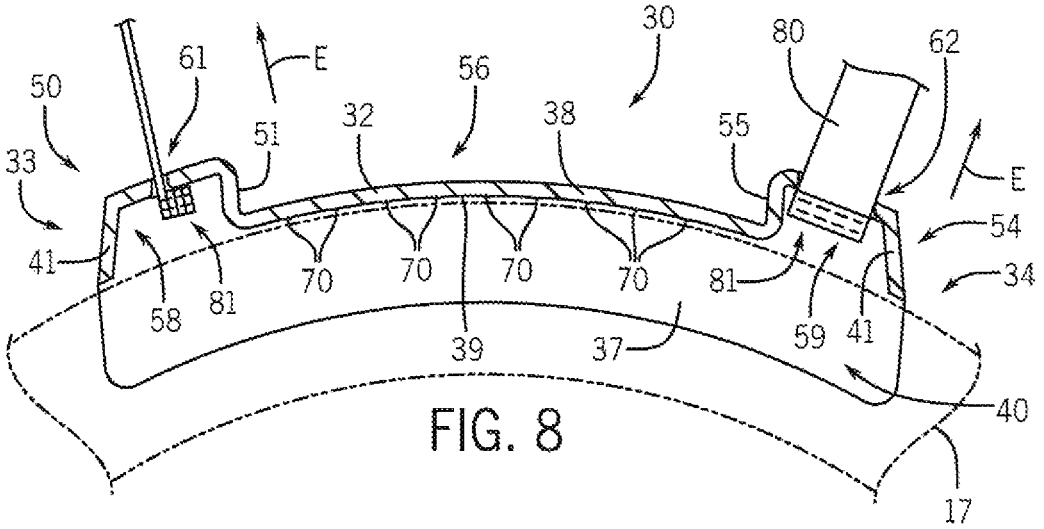
FIG. 8 is an example cross-sectional view of an example handgrip apparatus with coupling members coupled to the ends of the handgrip.

To assemble the handgrip apparatus 30, the user passes or inserts the second ends 82 of the coupling members 80 through the holes 61, 62 of the handgrip 32 (see directional arrows E on FIG. 8 that depict the direction in which the second ends 82 are inserted through the holes 61, 62). The second ends 82 are pulled through the holes 61, 62 and wrapped around the frame 11 (e.g. the front frame member 12, the rear frame member 13, a side frame member 14, 15). In the example depicted in FIG. 1, one of the coupling members 80 from each handgrip 32 wraps around the side frame member 14. The second ends 82 of the other coupling member 80 wraps around the rear side of the wheelchair 10 (e.g. the second ends 82 wrap around the rear side of the panels 21) and couple to each other. The first ends 81 (e.g. the thickened ends) do not pass through the holes 61, 62 because the widths W1 of the first ends 81 are greater than the width Y1 of the holes 61, 62. Accordingly, the first ends 81 are disposed in the cavities 58, 59 defined by the raised sections 50, 54 (FIG. 6) when the handgrip apparatus 30 is assembled and installed such that the first ends 81 are positioned away from the wheels 17 thereby preventing damage the first ends 81 which may occur if the first ends 81 contact and rub on the wheels 17. The first ends 81 are spaced apart or separated from the rear wheel 17 (e.g. the first ends 81 do not touch the rear wheel 17). The handgrip apparatus 30 is held adjacent to the rear wheel 17 in a neutral position (as shown in FIG. 1). In the neutral position, the channel 40 of the handgrip 32 may receive a portion of the rear wheel 17.

During operation, the user applies a force (e.g. pushes, presses, applies a radial force relative the axis 18) to the outer surface 38 such that the inner surface 39 and/or the projections 70 contact the rear wheel 17 and/or the circumferential tire 20 attached to the rear wheel 17. Simultaneous forward or rearward movement can then be applied by the user to rotate the rear wheels 17 and propel the wheelchair 10. As the forward movement is applied, the coupling member 80 coupled to the side frame member 14 stretches or elastically deforms (e.g. lengthens) and is tensioned. At the end of forward movement, the user releases the handgrip 32 and the tension in the coupling member 80 that is coupled to the side frame member 14 causes (e.g. pulls) the handgrip 32 to move rearwardly back into a neutral position (e.g. in the neutral position the coupling member 80 are not stretched or lengthened). Similarly, when the user a applies a force to the outer surface 38 for rearward movement the coupling member 80 coupled to the front frame member 12 stretches or elastically deforms (e.g. lengthens) and is put into tension. At the end of rearward movement, the user releases the handgrip 32 and the tension of the coupling member 80 coupled to the front frame member 12 causes the handgrip 32 to move forward into the neutral position. Accordingly, the coupling members 80 alternately increase in length and become tensioned based on the direction the user moves the handgrip 32, and the coupling member 80 that is tensioned moves the handgrip 32 back to the neutral position when the user releases the handgrip 32 while the coupling member 80 that is not tensioned does not exert a force on the handgrip 32 to move the handgrip 32 back to the neutral position. Note that the handgrip 32 of the present disclosure does not require a side compression or grasping force to be applied to the handgrip 32 in order for the inner surface 39 and/or the projections 70 to contact the rear wheel 17.

In certain examples, an apparatus for facilitating user propulsion of a wheelchair having a frame for supporting a user and a pair of rear wheels that rotate about an axis includes a handgrip having an outer surface and an opposite, inner surface with a plurality of projections extending therefrom such that when a radial force relative to the axis is applied to the outer surface the plurality of projections are configured to engage with a rear wheel in the pair of rear wheels such that the rear wheel can be rotated and the wheelchair propelled.

In certain examples, the plurality of projections are elongated and have a half-cylindrical shape and/or the plurality of projections are equally spaced part from each other. The handgrip has a first side and an opposite, second side, and the plurality of projections extend transverse to the first side and the second side. In certain examples, the plurality of projections extend perpendicular to the first side and the second side. The handgrip has a first side member, an opposite, second side member, and define a channel in which the rear wheel is received. In certain examples, the first side member and the second side member are curved, and wherein the handgrip has a U-shaped cross section. The handgrip has a first end having a first raised section that extends away from the outer surface and an opposite, second end having a second raised section that extends away from the outer surface such that an elongated cutout is defined between the first raised section and the second raised section and is configured to receive a hand of the user. The handgrip has a longitudinal centerline and the first raised section has a first raised surface that extends away from the outer surface and a second raised surface that extends away from the outer surface. The first raised surface transversely extends from the first side and the second raised surface transversely extends from the second side such that the first raised surface and the second raised surface intersect at the longitudinal centerline of the handgrip. In certain examples, the first raised surface and the second raised surface define a right angle there between. The second raised section has a first raised surface that extends away from the outer surface, and the first raised surface of the second raised section perpendicularly extends between the first side and the second side.

In certain examples, an apparatus for facilitating user propulsion of a wheelchair having a frame for supporting an user and a pair of rear wheel that rotate about an axis includes a handgrip having an outer surface and an opposite, inner surface such that when the user applies a radial force relative to the axis to the outer surface the inner surface is configured to contact a rear wheel such that the user can rotate the rear wheel and propel the wheelchair. A pair of coupling members configured to couple the handgrip to the frame and hold the handgrip in a neutral position. The pair of coupling members are configured to alternately increase in length and become tensioned as the user moves the handgrip away from the neutral position and rotates the rear wheel, and the coupling member that is tensioned moves the handgrip back to the neutral position when the user releases the handgrip. Each coupling member in pair of coupling members has a first end and an opposite, second end, and the handgrip defines a pair of holes through which the second ends of the coupling members pass such that the second end couple to the frame. The first ends of the coupling members are retained by the handgrip.

In certain examples, the second ends of the coupling members have fastening components that releasably couple the coupling members to the frame. The fastening components can be hook-and-loop pads. The first ends of the coupling members having a first width and each hole in the pair of holes has hole width that is less than the first width such that the first ends of the coupling members are retained by the handgrip. The handgrip has a centerline, and one of the pair of holes is elongated along the centerline and the other of the pair of holes is perpendicularly elongated relative to the centerline. The handgrip has a first end, an opposite second end, a first raised section positioned at the first end of the handgrip and defining a first cavity, a second raised section positioned at the second end of the handgrip and defining a second cavity, and a cutout positioned between the first raised section and the second raised section and configured to receive a hand of the user when the user applies a force to the outer surface. A first hole in the pair of holes is defined in the first raised section such that the first hole is in communication with the first cavity and a second hole in the pair of holes is defined in the second raised section such that the hole is in communication with the second cavity. The first ends of the coupling members are disposed in the first cavity and the second cavity such that the first ends of the coupling members are spaced apart from the wheel. The handgrip has a first side member and an opposite second side member that extend away from the inner surface such that the handgrip defines a channel configured to receive a portion of the rear wheel, and the channel is in communication with the first cavity and the second cavity.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An apparatus for facilitating user propulsion of a wheelchair having a frame for supporting a user and a pair of rear wheels that rotate about an axis, the apparatus comprising:

a handgrip having an outer surface and an opposite, inner surface with a plurality of projections extending therefrom, wherein when a radial force relative to the axis is applied to the outer surface by the user the plurality of projections are configured to engage with a rear wheel in the pair of rear wheels such that the rear wheel can be rotated and the wheelchair propelled;

wherein the projections in the plurality of projections are elongated and have a half-cylindrical shape;

wherein the projections in the plurality of projections are equally spaced part from each other;

wherein the handgrip has a first side and an opposite, second side, and wherein the plurality of projections extend transverse to the first side and the second side;

wherein the handgrip has a first side member and an opposite second side member and defines a channel configured to receive the rear wheel;

wherein the handgrip has a first end having a first raised section that extends away from the outer surface and an opposite, second end having a second raised section that extends away from the outer surface, and wherein an elongated cutout is defined between the first raised section and the second raised section and is configured to receive a hand of the user.

2. The apparatus according to claim 1, wherein the plurality of projections extend perpendicular to the first side and the second side.

3. The apparatus according to claim 1, wherein the first side member and the second side member are curved, and wherein the handgrip has a U-shaped cross section.

4. The apparatus according to claim 1, wherein the handgrip has a longitudinal centerline, wherein the first raised section has a first raised surface that extends away from the outer surface and a second raised surface that extends away from the outer surface, and wherein the first raised surface of the first raised section transversely extends from the first side of the handgrip and the second raised surface of the first raised section transversely extends from the second side of the handgrip such that the first raised surface and the second raised surface of the first raised section intersect at the longitudinal centerline of the handgrip.

5. The apparatus according to claim 4, wherein the first raised surface and the second raised surface of the first raised section define a right angle there between.

6. The apparatus according to claim 4, wherein the second raised section has a first raised surface that extends away from the outer surface, and wherein the first raised surface of the second raised section perpendicularly extends between the first side of the handgrip and the second side of the handgrip.

7. An apparatus for facilitating user propulsion of a wheelchair having a frame for supporting a user and a pair of rear wheels that rotate about an axis, the apparatus comprising:

a handgrip having an outer surface and an opposite, inner surface, wherein when the user applies a radial force relative to the axis to the outer surface the inner surface is configured to engage a rear wheel in the pair of rear wheels such that the user can rotate the rear wheel and propel the wheelchair; and a pair of coupling members configured to couple the handgrip to the wheelchair and hold the handgrip in a neutral position, wherein the pair of coupling members are further configured to alternately increase in length and become tensioned as the user moves the handgrip away from the neutral position to rotate the rear wheel, and wherein the coupling member that is tensioned moves the handgrip back to the neutral position when the user releases the handgrip;

wherein each coupling member in pair of coupling members has a first end that is retained by the handgrip and an opposite, second end that configured to couple to the wheelchair;

wherein the handgrip defines a pair of holes through which the second ends of the coupling members pass such that the second ends couple to the wheelchair; and wherein the first ends of the coupling members have a first width, and wherein each hole in the pair of holes has a hole width that is less than the first width such that the first ends of the coupling members are retained by the handgrip.

8. The apparatus according to claim 7, wherein the handgrip is a first handgrip and wherein the pair of coupling members is a first pair of coupling members; and further comprising:

a second handgrip having an outer surface and an opposite, inner surface, wherein when the user applies a radial force to the outer surface of the second handgrip the inner surface of the second handgrip is configured to engage the other rear wheel in the pair of rear wheels such that the user can rotate the other rear wheel and propel the wheelchair; and a second pair of coupling members configured to couple the second handgrip to the wheelchair and hold the second handgrip in a neutral position, wherein one coupling member in the second pair of coupling members couples to one coupling member in the first pair of coupling members.

9. The apparatus according to claim 8, wherein the one coupling member in the second pair of coupling members that couples to the one coupling member of the first pair of coupling members couples thereto with fastening components, and wherein the fastening components are hook-and-loop pads.

10. The apparatus according to claim 7, wherein the handgrip has a centerline, and wherein one hole of the pair of holes is elongated along the centerline and the other hole of the pair of holes is perpendicularly elongated relative to the centerline.

11. The apparatus according to claim 7, wherein the handgrip has a first end, an opposite second end, a first raised section positioned at the first end of the handgrip and defining a first cavity, a second raised section positioned at the second end of the handgrip and defining a second cavity, and a cutout positioned between the first raised section and the second raised section and configured to receive a hand of the user when the user applies a force to the outer surface;

wherein a first hole in the pair of holes is defined in the first raised section such that the first hole is in communication with the first cavity and a second hole in the pair of holes is defined in the second raised section such that the second hole is in communication with the second cavity; and wherein the first ends of the coupling members are disposed in the first cavity and the second cavity, respectively, such that the first ends of the coupling members are spaced apart from the rear wheel.

12. The apparatus according to claim 11, wherein the handgrip has a first side member and an opposite second side member that extend away from the inner surface such that the handgrip defines a channel configured to receive a portion of the rear wheel, and wherein the channel is in communication with the first cavity and the second cavity.

13. An apparatus for facilitating user propulsion a wheelchair having a frame for supporting a user and a pair of rear wheels that rotate about an axis, the apparatus comprising:

a handgrip having:

a first end and an opposite, second end;

a first side and an opposite, second side;

an outer surface and an opposite, inner surface with a plurality of projections extending therefrom, the plurality of projections are equally spaced apart from each other and extend transverse to the first side and the second side, wherein each projection in the plurality of projections is elongated and has a half-cylindrical shape, and wherein when the user applies a force to the outer surface the plurality of projections are configured to engage with a rear wheel in the pair of rear wheels such that the user can rotate the rear wheel and propel the wheelchair;

a first raised section positioned at the first end of the handgrip and defining a first cavity and a second raised section raised section positioned at the second end of the handgrip and defining a second cavity;

a cutout defined between the first raised section and the second raised section and configured to receive a hand of the user;

a first hole defined in the first raised section and in communication with the first cavity, the first hole having a hole width; and a second hole defined in second raised section and in communication with the second cavity, the second hole having a hole width; and a first coupling member and a second coupling member configured to couple the handgrip to the wheelchair and hold the handgrip in a neutral position, the first coupling member and the second coupling member each having a first end and an opposite, second end;

wherein the first coupling member and a second coupling member are configured to alternately increase in length and become tensioned as the user moves the handgrip away from the neutral position and rotates the rear wheel, and wherein the coupling member that is tensioned moves the handgrip back to the neutral position when the user releases the handgrip;

wherein the second end of the first coupling member is configured to pass through the first hole to thereby couple the handgrip to the wheelchair, and wherein the first end of the first coupling member is retained by the handgrip in the first cavity such that the first end of the first coupling member is spaced apart from the rear wheel; and wherein the second end of the second coupling member is configured to pass through the second hole to thereby couple the handgrip to the wheelchair, and wherein the first end of the second coupling member is retained by the handgrip in the second cavity such that the first end of the second coupling member is spaced apart from the rear wheel.

14. An apparatus for facilitating user propulsion of a wheelchair having a frame for supporting a user and a pair of rear wheels that rotate about an axis, the apparatus comprising:

a handgrip having an outer surface, an opposite inner surface, a first end with a first raised section extending away from the outer surface, and an opposite second end with a second raised section extending away from the outer surface, the handgrip extends between the first end and the second end and a cutout extends between the first raised section and the second raised section, wherein the handgrip has a first hole with a first hole width and a second hole with a second hole width, and wherein as the user engages the outer surface and moves the handgrip, the inner surface is configured to engage a rear wheel in the pair of rear wheels such that the handgrip rotates the rear wheel to thereby propel the wheelchair; and a first coupling member and a second coupling member configured to couple the handgrip to the wheelchair;

wherein the first coupling member has a first end with a first end width that is greater than the first hole width such that as the first coupling member extends through the first hole, the first end of the first coupling member contacts the handgrip and the handgrip blocks passage of the first end of the first coupling member through the first hole; and wherein the second coupling member has a first end with a first end width that is greater than the second hole width such that as the second coupling member extends through the second hole, the first end of the second coupling member contacts the handgrip and the handgrip blocks passage of the first end of the second coupling member through the second hole.

15. The apparatus according to claim 14, wherein the first end of the first coupling member is in a first cavity of the handgrip such that the first end of the first coupling member is spaced apart from the rear wheel, and wherein the first end of the second coupling member is in a second cavity of the handgrip such that the first end of the second coupling member is spaced apart from the rear wheel.

* * * * *